US012800257B2

(12) United States Patent
Lamboy et al.

(10) Patent No.: US 12,800,257 B2
(45) Date of Patent: Nov. 17, 2026

(54) BULL BARREL ASSEMBLY FOR AN AIRGUN

(71) Applicant: Umarex USA, Inc., Fort Smith, AR (US)

(72) Inventors: Stephen R. Lamboy, Fort Smith, AR (US); Kyle Bruso, Lavaca, AR (US)

(73) Assignee: Umarex USA, Inc., Fort Smith, AR (US)

( * ) Notice: Subject to any disclaimer, the term of this patent is extended or adjusted under 35 U.S.C. 154(b) by 35 days.

(21) Appl. No.: 19/243,172

(22) Filed: Jun. 19, 2025

(65) Prior Publication Data

US 2025/0389515 A1 Dec. 25, 2025

Related U.S. Application Data

(60) Provisional application No. 63/662,518, filed on Jun. 21, 2024.

(51) Int. Cl.
*F41B 11/70* (2013.01)

(52) U.S. Cl.
CPC ..... *F41B 11/70* (2013.01)

(58) Field of Classification Search
CPC ..... F41B 11/00; F41B 11/70; F41A 21/00; F41A 21/02; F41A 21/04; F41A 21/20
See application file for complete search history.

(56) References Cited

U.S. PATENT DOCUMENTS

| | | | | |
|---|---|---|---|---|
| 5,856,631 | A * | 1/1999 | Julien | F41A 21/02 42/78 |
| 6,189,431 | B1 * | 2/2001 | Danner | F41A 21/02 42/76.02 |
| 6,494,195 | B2 | 12/2002 | Perry | |
| 9,182,191 | B2 | 11/2015 | Gardner, Jr. | |
| 10,619,970 | B2 | 4/2020 | Gardner, Jr. | |
| 10,890,399 | B2 | 1/2021 | Gardener, Jr. | |
| 11,079,194 | B1 * | 8/2021 | Sinnema | F41A 21/02 |
| 11,243,039 | B2 | 2/2022 | Gardner, Jr. | |
| 11,385,013 | B2 | 7/2022 | Boretto | |
| 11,732,988 | B2 | 8/2023 | Borett | |
| 12,169,106 | B2 | 12/2024 | Boretto | |
| 12,241,713 | B2 | 3/2025 | Gardner, Jr. | |
| 2003/0182838 | A1 * | 10/2003 | Kessler | F41A 21/00 42/79 |

(Continued)

*Primary Examiner* — Benjamin P Lee
(74) *Attorney, Agent, or Firm* — Eric B. Fugett; Mark A. Pitchford; Pitchford Fugett, PLLC

(57) ABSTRACT

A bull barrel assembly for an airgun includes a metal barrel received in a composite barrel sleeve. Two tensioners are threaded on the respective opposite threaded ends of the barrel against the respective opposite ends of the sleeve such that the sleeve is compressed and the barrel is tensioned. The compressed sleeve is rigidly secured to the tensioned barrel by an adhesive. The barrel assembly is formed by coating a surface of a metal barrel with an adhesive, assembling the adhesive-coated barrel into a composite barrel sleeve before the adhesive sets, tightening the tensioners onto the respective opposite threaded ends of the barrel and against the respective ends of the sleeve to place the barrel in tension and the sleeve in compression before the adhesive sets, and allowing the adhesive to cure while the sleeve is in compression and the barrel is in tension.

15 Claims, 8 Drawing Sheets

(56) References Cited

U.S. PATENT DOCUMENTS

| | | | | |
|---|---|---|---|---|
| 2006/0260597 | A1* | 11/2006 | Anderson | F41A 21/02<br>42/76.02 |
| 2016/0209144 | A1* | 7/2016 | Tertin | B23P 11/025 |
| 2020/0378710 | A1* | 12/2020 | Ekstrom | F41A 21/32 |
| 2022/0018622 | A1* | 1/2022 | Massarello | F41A 21/04 |
| 2023/0014337 | A1* | 1/2023 | Schlosser | F41A 21/04 |
| 2026/0160514 | A1* | 6/2026 | Painter | F41A 21/02 |

* cited by examiner

BULL BARREL ASSEMBLY FOR AN AIRGUN

CROSS-REFERENCES TO RELATED APPLICATIONS

This application claims priority to and hereby incorporates by reference in its entirety U.S. Provisional Patent Application No. 63/662,518 entitled "SLEEVED TENSIONED BARREL ASSEMBLY" and filed on Jun. 21, 2024.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present disclosure relates generally to the field of airguns. More specifically, the present disclosure relates to barrels for airguns.

All gun barrels vibrate and flex when firing a projectile therethrough. For example, upon shooting a firearm, the rapid expulsion of the chemical propellant (e.g., combustion gases from a cartridge) causes immense pressure differentials at the muzzle and chamber that in turn create wave propagations throughout the length of the barrel, causing the muzzle end of the barrel to undulate slightly. A similar phenomenon happens in airguns upon release of a compressed gas to propel a projectile through the barrel. This movement (e.g., up, down, left, right, or circular) of the barrel during firing is often referred to as "barrel harmonics" or "barrel whip." The "whip" of a barrel is a function of the material composition, length, and thickness of the barrel. Barrel whip adversely impacts the trajectory of the projectile, and thus decreases accuracy and reliability of the gun.

To mitigate barrel whip, some firearm barrels are designed to be relatively thicker than normal OEM barrels with a uniform diameter throughout their length. Such barrels are known as "bull barrels" (also called "target" or "heavy" barrels). Bull barrels characteristically feature a non-tapered, cylindrical barrel that is thicker and heavier than a standard barrel. In comparison to a standard barrel, a bull barrel vibrates less (i.e., has less barrel whip) due to its greater thickness and absorbs more heat due to its increased mass, which makes the barrel less prone to warping under repeated fire. A bull barrel increases accuracy and reliability, and is thus typically preferred by precision and competition shooters.

Though common in rimfire rifles, bull barrels are not used in airguns due to their increased weight and cost. Additionally, in comparison to a rimfire rifle, an airgun typically functions at much lower pressures and does not require a heavier bull barrel to mitigate heat. For this reason, airguns typically include a comparatively (to firearms) thin barrel. However, some currently available high-caliber airguns have significant issues with barrel whip because their standard barrels cannot effectively accommodate the increased operational pressures required to fire higher-caliber projectiles.

Alternatives to bull barrels have not been successfully implemented in airguns. Some such alternatives include barrel liners, shrouds with weighted tuners, and sleeves. As discussed herein, each alternative fails to provide desirable barrel harmonics by effectively eliminating barrel whip. For example, one prior art airgun design includes a thin and rifled liner that is fitted within a barrel tube. Often, this liner is so thin that the rifling can be pressed therein from the outside of the liner. To assist in reducing barrel whip, some liners further include vibration absorbers in the form of slip-on rubber O-rings that fit over the outer diameter of the liner, and which are often imprecisely positioned. Unfortunately, the liner is too thin to effectively reduce barrel whip.

Another currently available airgun barrel design includes a shroud with an integrated weighted tuner. In application, the shroud and weighted tuner are slid onto the barrel, and the weighted tuner is rotated to adjust its relative position for accordingly tuning the barrel harmonics. However, such a design does not effectively eliminate barrel whip—it only reduces the amplitude of the whip, at best. Additionally, adjusting a tuner can be a time-consuming and arduous process.

As an alternative to a shroud, some currently available airgun barrels include a stiff sleeve fitted over a portion of the barrel. The sleeve is typically comprised of carbon fiber and has a similar thickness to that of the barrel. In one prior art design, a front portion of the barrel can be incrementally tensioned using a clamp on the barrel at the receiver, and a jam nut at the muzzle of the barrel. Upon tightening the jam nut, the front portion of the sleeve becomes compressed and adds additional rigidity to the front portion of the barrel covered by the sleeve. Though such a prior art sleeve can help to incrementally increase the rigidity of a portion of a thin barrel, the entire length of the barrel is still allowed to undesirably vibrate as the jam nut at the muzzle functions primarily as a retainer for the sleeve. Thus, in such existing alternatives to bull barrels, there still persists a significant amount of barrel whip which negatively impacts the accuracy of the airgun.

Accordingly, there exists a need for improvements in barrels for airguns.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

Aspects of the disclosure provide a bull barrel assembly for an airgun. The barrel is tensioned from each end, which increases a tensile strength of the barrel along its entire length. The bull barrel assembly has a thick diameter relative to available airgun barrels, and is stiff across its entire length so as to effectively eliminate barrel whip along the full length thereof.

In one aspect, a bull barrel assembly for an airgun includes a barrel that has a first threaded end and a second threaded end opposite the first threaded end and a sleeve configured to fit over and be rigidly secured to the barrel. The barrel assembly further includes a first tensioner configured to threadably connect to the first threaded end of the barrel, and a second tensioner configured to threadably connect to the second threaded end of the barrel. The first and second tensioners are configured to compress the sleeve across its entire length and tension the barrel across its entire length when properly assembled on the barrel.

Numerous other objects, advantages and features of the present disclosure will be readily apparent to those of skill in the art upon a review of the following drawings and description of a preferred embodiment.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

Figure 1:
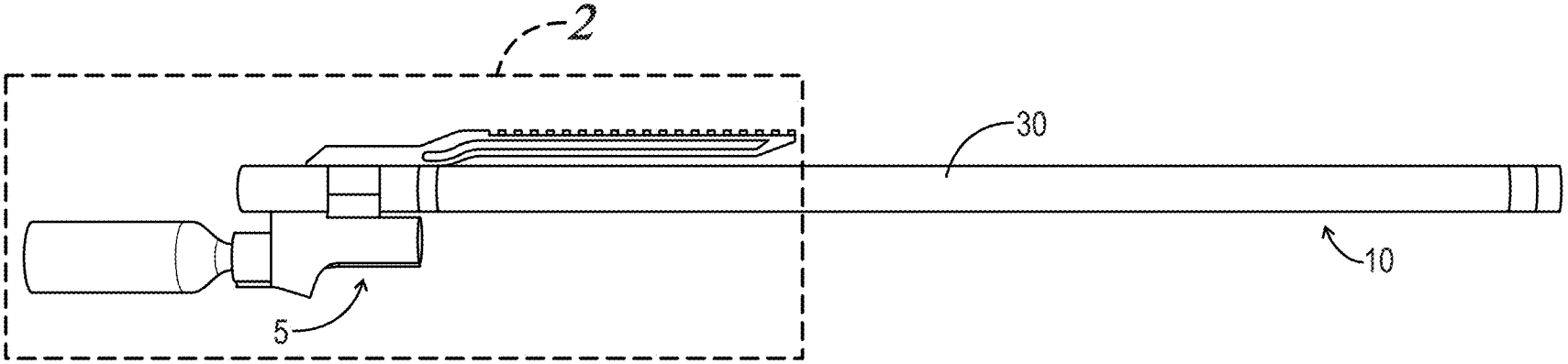
FIG. 1 is a perspective view of a bull barrel assembly for an airgun constructed in accordance with an embodiment of the present invention seated in an airgun receiver. The airgun is indicated schematically with the stock and firing mechanism omitted for clarity.
Figure 2:
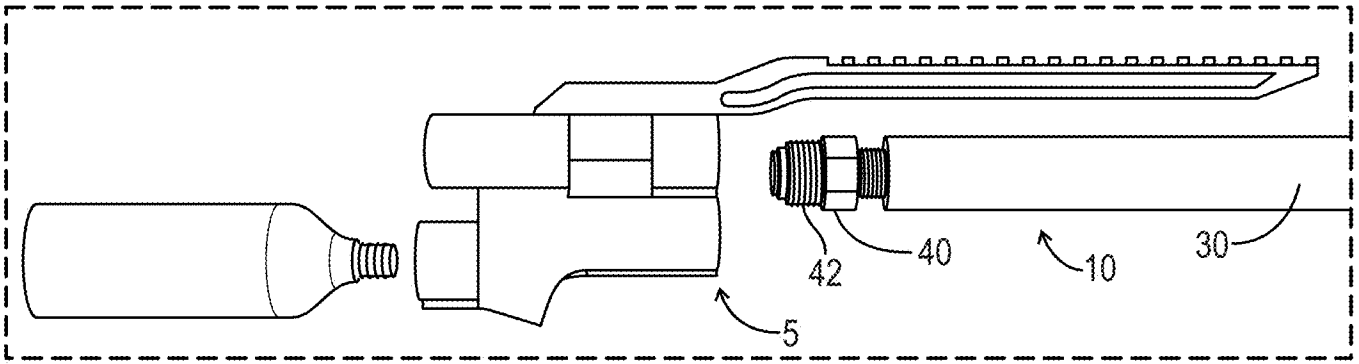
FIG. 2 is an enlarged, partially exploded view of the objects of FIG. 1.
Figure 3:
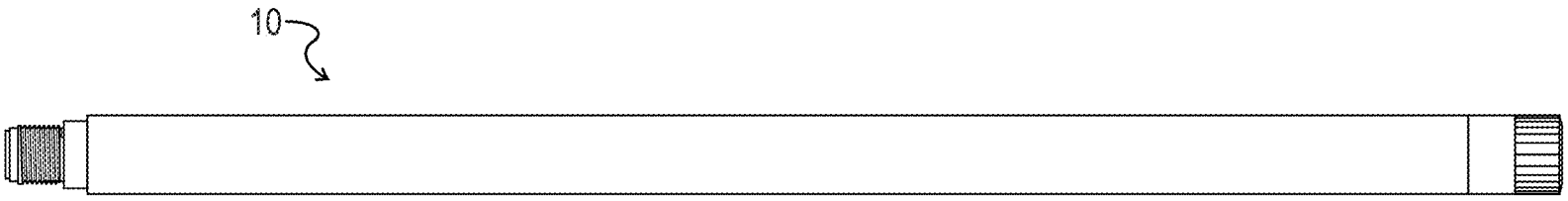
FIG. 3 is a side view of the barrel assembly of FIG. 1.
Figure 4:
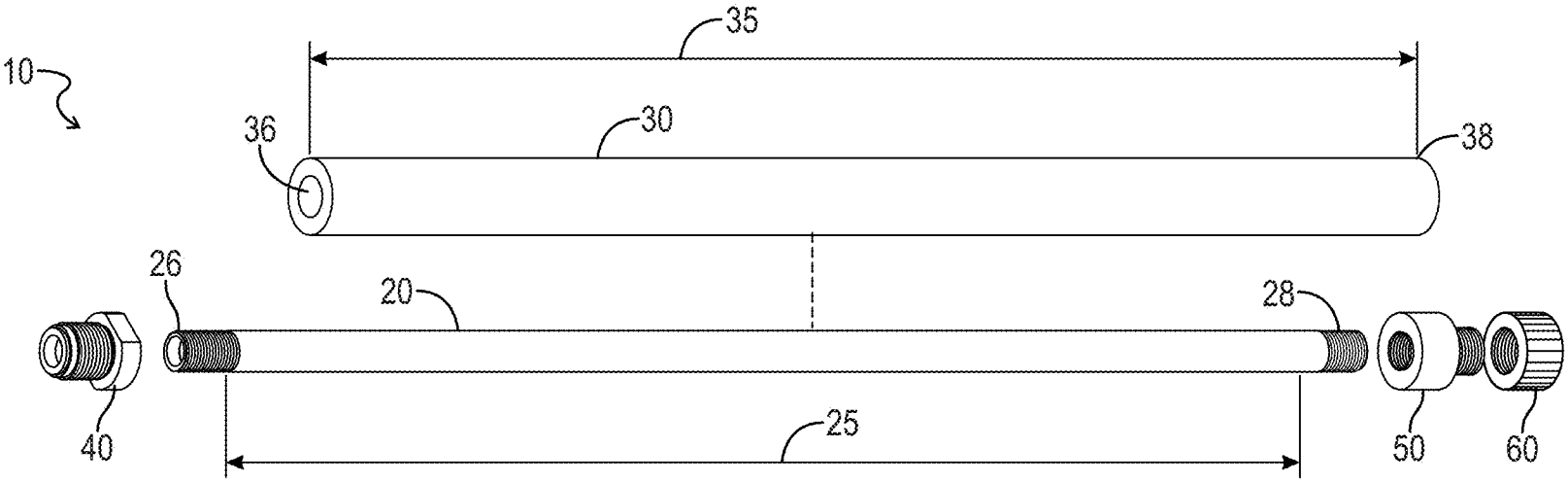
FIG. 4 is an exploded rear perspective view of the barrel assembly of FIG. 3.
Figure 5:
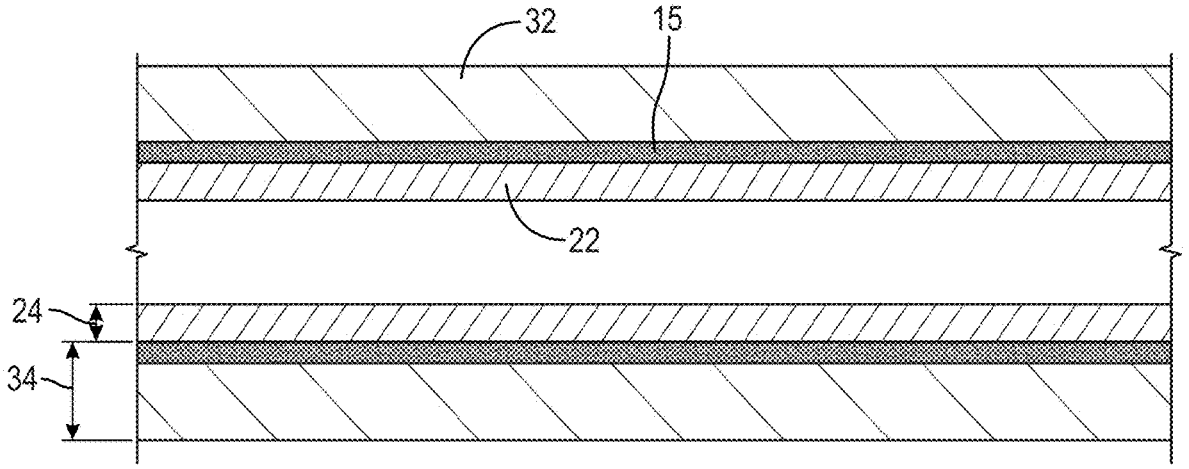
FIG. 5 is a schematic and partial side cutaway view of the barrel assembly of FIG. 3. The thickness of the adhesive layer has been exaggerated for clarity.

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an "upright" position is considered to be the position of apparatus components while in proper operation or in a natural resting position as described herein. The upright firing position of an airgun is a generally level firing position. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

As used herein, the terms "front" and "forward" means in a direction extending toward the muzzle of the airgun. In some cases, the term "forward" can also mean forward beyond the muzzle of the airgun. The terms "aft" and "rear" means in a direction extending away from the muzzle of the airgun toward a rear end of a airgun. In some cases, the term "rearward" can also mean rearward beyond the rear end of the airgun.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

The terms "significantly", "substantially", "approximately", "about", "relatively," or other such similar terms that may be used throughout this disclosure, including the claims, are used to describe and account for small fluctuations, such as due to variations in manufacturing or processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%. In some contexts, and unless otherwise specifically defined hereinafter, the term "substantially" means what is considered normal or possible within the limits of applicable industry-accepted manufacturing practices and tolerances.

The terms "set" and "sets" when used herein with reference to an adhesive mean that the adhesive has hardened enough to hold its shape and form a bond, but it has not reached full strength.

The terms "cure," "cures," and "cured" when used herein with reference to an adhesive mean that the adhesive has undergone a complete chemical reaction, resulting in its full strength and final properties.

The term "adhesive" as used herein means any substance (including a mix of substances such as, but not limited to, multi-part epoxies) applied to one or both surfaces of two separate items that binds them together and resists their separation.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Referring now to FIGS. 1-13, there is depicted a bull barrel assembly 10 for an airgun 2. The barrel assembly 10 generally includes a threaded metal airgun barrel 20, a thick composite sleeve 30 fitted over and permanently bonded to the barrel 20 by an adhesive 15, a rear tensioner 40 threaded tightly on the threaded rear end or breech 26 of the barrel 20 against the rear end 36 of the sleeve 30, a front tensioner 50 threaded tightly on the front end or muzzle 28 of the barrel 20 against a front end 38 of the sleeve 30, and a thread protector 60 threaded on the front tensioner 50.

More specifically, the bull barrel assembly 10 includes a threaded metal barrel 20 and a thick composite (e.g., carbon fiber) sleeve 30 in which the barrel 20 is received. The barrel 20 includes an externally threaded rear end 26, an externally threaded front end 28, and a barrel length 25. The sleeve 30 includes a rear end 36, a front end 38, and a sleeve length 35. The sleeve length 35 is less than the barrel length 25. The barrel 20 sidewall 22 has a wall thickness 24 that is less than the wall thickness 34 of the sidewall 32 of the sleeve 30. As such, the metal barrel 20 is relatively thinner than the sleeve 30. The sleeve 30 is rigidly secured to the barrel 20 via an adhesive 15.

The bull barrel assembly 10 also includes a rear tensioner (i.e., barrel nut) 40 configured to thread onto the externally threaded rear end 26 (i.e., breech) of the barrel 20, a front tensioner (i.e., end bushing) 50 configured to thread onto the externally threaded front end 28 (i.e., muzzle) of the barrel 20, and a thread protector 60 configured to be threaded onto the external threads 52 of the front tensioner (not shown) 50. In some embodiments, a suppressor or other muzzle device (not shown) can be threaded onto the external threads 52 of the front tensioner 50. The rear tensioner 40 includes external threads 42 configured to be screwed into (i.e., seated) in the receiver 5 of the airgun. As such, the rear tensioner 40 is configured to be threadingly (i.e., matingly) engaged with complimentary threads (not shown) on the inside of the receiver 5. The rear and front tensioners 40, 50 each define a respective bore or through hole 45, 55 sized to receive an airgun projectile (not shown) therethrough.

In assembly, the barrel 20 can be coated with adhesive 15, placed inside the sleeve 30, and tensioned by threading the tensioners 40, 50 onto the respective opposite ends 26, 28 of the barrel 20 and tightening the tensioners 40, 50 against the respective opposite ends 36, 38 of the sleeve 30 before the adhesive 15 sets (i.e., while the adhesive is in a liquid phase). The tensioners 40, 50 are then torqued to a level that achieves the desired barrel straightness and stiffness. This places the barrel 20 in tension and the sleeve 30 in compression before the adhesive 15 sets. The barrel 20 is in tension along the entire length 25 of the barrel 20, while the sleeve 30 is in compression along the entire length 35 of the sleeve 30. The barrel assembly 10 is then allowed to cure under load. Once cured, the resulting thin adhesive layer 15 between the barrel 20 and sleeve 30 forms a single, permanently bonded barrel assembly 10 with increased tensile strength that mimics the structure and performance of a traditional firearm bull barrel. The adhesive 15 can be any desired adhesive, such as, but not limited to, a single- or multi-part epoxy or epoxy resin that cures without external heat. Heat resistant epoxies can, but need not be, used because airguns do not generate appreciable heat during operation. Other suitable adhesives can be used and will be apparent to those of skill in the art.

When the compressed sleeve 30 is permanently bonded to the tensioned barrel 20 as described herein, the assembled barrel assembly 10 forms a single unit with markedly increased rigidity along its entire length compared to currently available airgun barrels. The assembled barrel assembly 10 also has a thicker (relative to available airgun barrels) and uniform diameter along the full length of the barrel 20. As such, the novel barrel assembly 10 disclosed herein effectively eliminates barrel whip, thereby increasing the accuracy and reliability of the airgun in which it is installed. In this way, the barrel assembly 10 disclosed herein mimics a firearm bull barrel.

Advantageously, since the sleeve 30 extends practically along the full length 25 of the barrel 20, except for the exposed externally threaded ends 26, 28 of the barrel 20 which are each covered by a respective tensioner 40, 50, nearly the full length 25 of the barrel is reinforced by the sleeve 30. Furthermore, the sleeve 30 in combination with both tensioners 40, 50 defines an augmented and uniform diameter of the barrel assembly 10 across its entire length, which significantly improves the harmonic profile of the barrel 20. Still further, since the tensioners 40, 50 also completely cover the ends 26, 28 of the barrel 20, upon tightening the tensioners 40, 50 the entire length 25 of the barrel (from end to end) becomes reinforced by the action of the tensioners 40, 50 against the ends 36, 38 of the sleeve 30. In more detail, when tightened, each tensioner 40, 50 applies an inwardly directed compression force on the sleeve 30 (at each end 36, 38 thereof), thus compressing the sleeve 30 along its entire length 35. Simultaneously, each tensioner 40, 50 applies a longitudinally outwardly directed tensile force on the barrel 20 (at each end 26, 28 thereof), thus pulling outwardly upon and tensioning barrel 20 along its entire length 25. In this way, the tensioners 40, 50 simultaneously compress the full length 35 of the sleeve 30 and tension the full length 25 of the barrel 20. As a result, the barrel 20 has an augmented tensile strength, across its entire length, which significantly reduces barrel movement as a projectile travels through the barrel assembly 10.

Furthermore, since the sleeve 30 is permanently secured to the barrel 20 while the tensioners 40, 50 hold the sleeve 30 in compression and the barrel 20 in tension, the resulting assembled and solidly laminated unit 10 practically cannot bend, thereby making the assembled barrel assembly 10 vibration resistant, minimizing barrel deflection, and maximizing barrel rigidity over the entire length of the barrel. This in turn replicates the efficacy of traditional thick bull barrels for firearms with much less weight and an even greater vibration resistance due to its resulting solid lamination and the increased stiffness from the composite sleeve 30 (which can be carbon fiber) which is stiffer in comparison to a solid steel bull barrel. No known prior art bull barrel or bull barrel alternative has such advantages, wherein barrel harmonics are improved across the entire length and resulting width of the barrel.

In some embodiments, in assembly, the adhesive 15 can be initially applied onto the outer surface 21 of the barrel 20 and/or the inside surface 33 of the sleeve 30. Thereafter, the sleeve 30 can then be slip-fitted onto the barrel 20. Alternatively, the sleeve 30 can be initially slip-fitted onto the barrel 20 and thereafter the adhesive 15 can be injected into the space between the outer surface 21 of the barrel 20 and the inside surface 33 of the sleeve 30 using a high-pressure adhesive injector (not shown). As shown in the schematic cutaway view of FIG. 5, the adhesive 15 can form a substantially uniform adhesive layer 15 in between the outer surface 21 of the barrel 20 and the inner surface 33 of the sleeve 30. Once the barrel 20 and the sleeve 30 are coupled and glued, the tensioners 40, 50 can be threaded onto the threaded ends 26, 28 of the barrel 20 before the adhesive 15 has set. While the adhesive 15 is still malleable before becoming set or hardened, the barrel 20 can be tensioned to a desired tension level by tightening the tensioners 40, 50 (i.e., threading the tensioners inwardly toward each other from each end 26, 28 of the barrel 20) such that the tensioners inwardly compress the sleeve 30 from each end 36, 38 of the sleeve 30. Once the desired tension and compression has been achieved, the adhesive 15 can be allowed to cure so that the sleeve 30 becomes permanently bonded onto the barrel 20 under load. In some embodiments, the adhesive 15 can also permanently bond the tensioners onto the ends of barrel 26, 28 and the sleeve 36, 38. The barrel assembly 10 is complete and ready for use once assembled and the adhesive 15 cured.

The barrel 20 can have any desired length, caliber, diameter, and wall thickness. For example, the barrel 20 can have a length of 28.5 in. (72 cm) and have an inner diameter of 0.45 in. (1.14 cm) for firing .45 caliber projectiles therethrough. The barrel can have any desired outer diameter, such as an outer diameter of 0.495-0.625 in. (1.25-1.58 cm), resulting in a wall thickness of 0.045-0.175 in. (0.11-0.44 cm) when chambered in .45 caliber. As shown, the barrel has an outer diameter of 0.625 in., with a wall thickness of 0.175 in. Each threaded end 26, 28 of the barrel 20 can have any desired configuration and length of threads. For example, the rear end 26 of the barrel 20 can have a male ⅝-18 2 A thread pattern and a length of 1 in. (2.54 cm) extending inwardly from the rear end of the barrel. Additionally, for example, the front end 28 of the barrel 20 can have a male ⅝-18 2 A thread pattern and a length of 0.707 in. (1.79 cm) extending inwardly from the distal end of the barrel. The barrel 20 can also have any desired rifling. For example, the barrel can have 0.450 in. lands, 0.457 in. grooves, with 6 grooves, and a 1:24 twist. Alternatively, the barrel may comprise a smooth bore. The barrel can be comprised of any suitable metal or metal alloy, such as steel. For ease of manufacturing and improved barrel accuracy, each of the barrel 20 sidewall 22 and the sleeve 30 sidewall 32 and is straight (i.e., with parallel sides). That is, the barrel 20 and sleeve 30 are not tapered. In preferred embodiments, the barrel 20 is not a thin barrel liner, rather, the barrel 20 is a standard weight (or heavier) airgun barrel.

Figure 6:
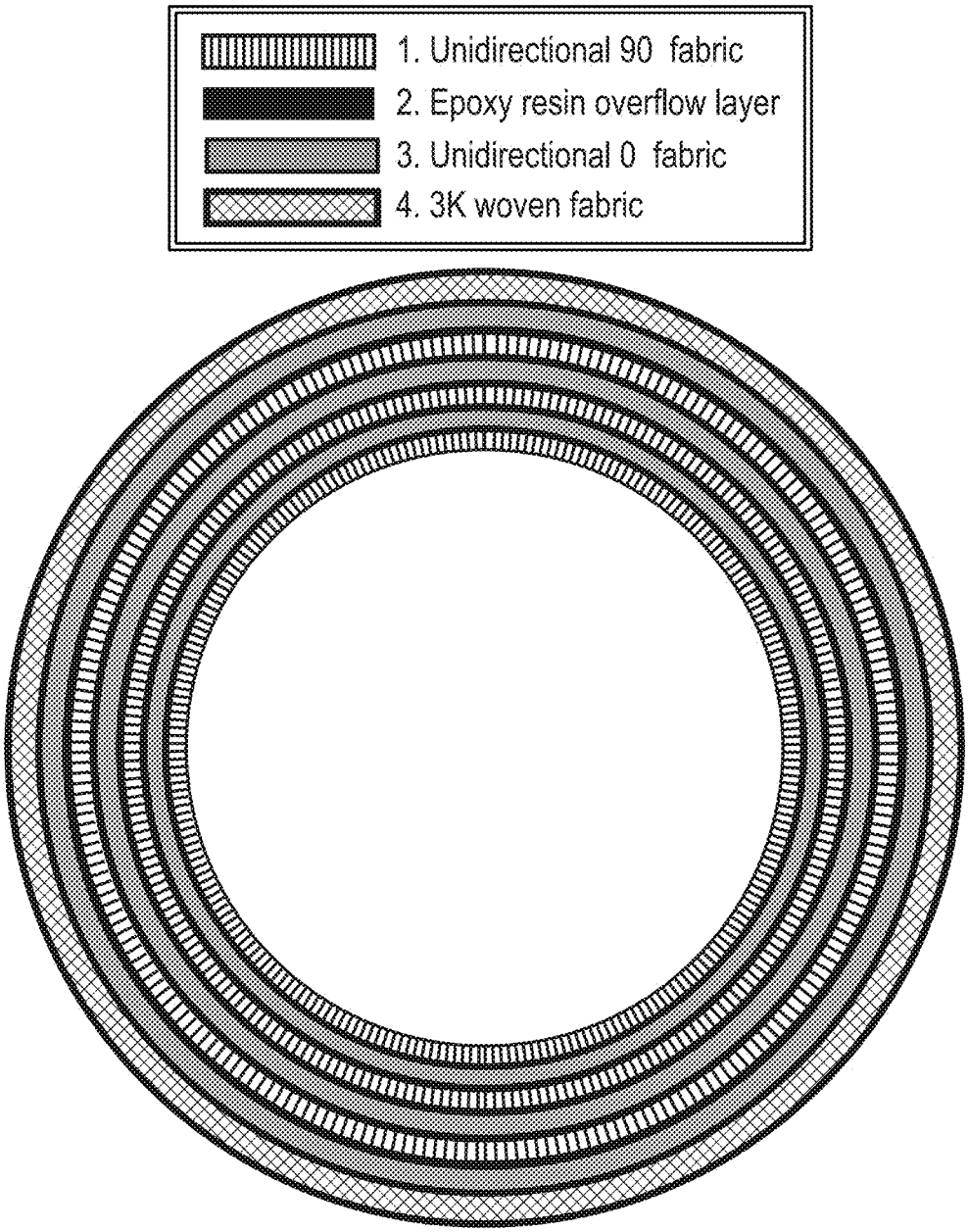
FIG. 6 is a section view of the barrel sleeve of FIG. 5.

The sleeve 30 can have any desired length, inner and outer diameter, and wall thickness. For example, the sleeve can have a length of 26.79 in. (68 cm). The inner diameter of the sleeve can be slightly larger than the outer diameter of the barrel, such as 0.496-0.506 in. (1.25-1.28 cm). The sleeve can have any desired outer diameter, such as 0.75-1.25 in. (1.9-3.17 cm), with a resulting wall thickness 24 being 0.25-0.75 in. (0.63-1.9 cm). In one embodiment, the wall thickness 34 of the sleeve is 0.54 in. In comparison to the barrel 20, the sleeve 30 is thicker than the barrel 20, such as by 1.5 to 10 times, or more, greater than the thickness 24 of the barrel 20. The sleeve 30 can comprise any desired composite material(s), such as carbon fiber. A non-limiting example of one suitable carbon fiber composite sleeve 30 is depicted in FIG. 6.

Figure 7:
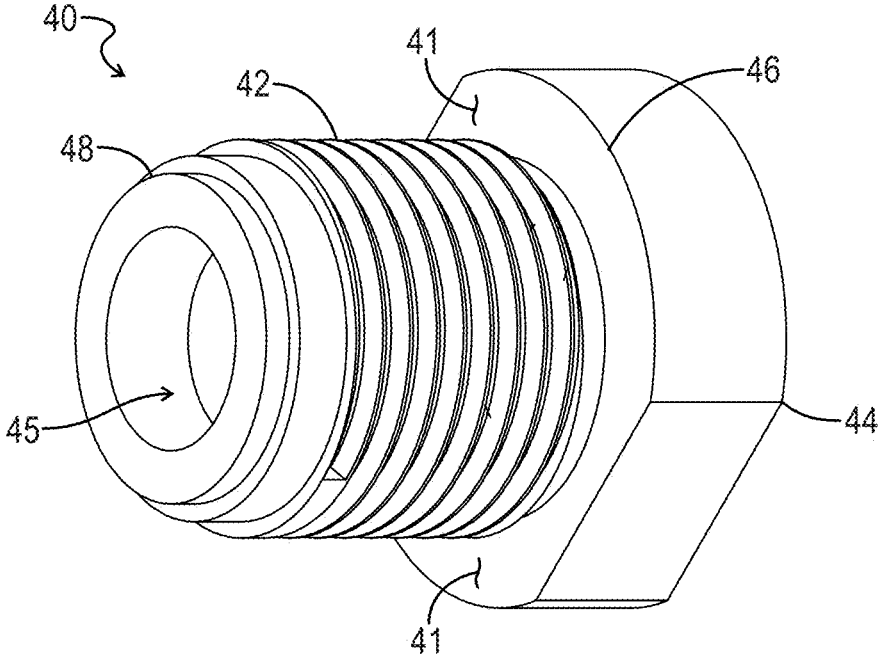
FIG. 7 is a perspective view of the rear tensioner (i.e., barrel nut) of FIG. 4.
Figure 8:
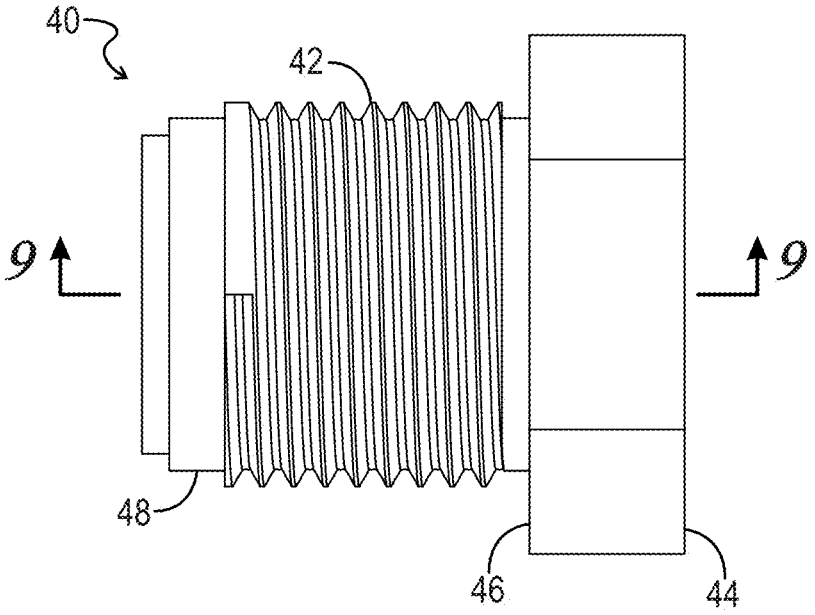
FIG. 8 is a side view of the tensioner of FIG. 7.
Figure 9:
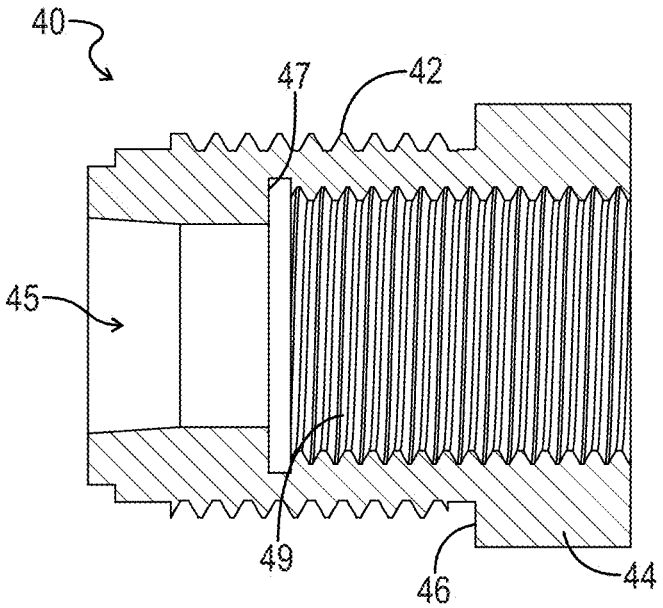
FIG. 9 is a sectional view taken along line 9-9 of FIG. 8.

Referring specifically to FIGS. 7-9, in one embodiment, the rear tensioner 40 can be a barrel nut 40 that includes a head 44 with a radially protruding flange or shoulder 46 that abuts the rear end 36 of the sleeve 30 and a protruding boss or stem 48 that is at least partially internally threaded, with female threads 49 in its through hole 45 (that correspond to the male threads on the rear end 26 of the barrel 20), and externally threaded with male threads 42 (that correspond to female threads of a mounting hole in the receiver or action 5). In detail, the front-facing surface 41 (i.e., the sleeve-facing surface) of the flange 46 of the rear tensioner 40 can contact and compress the opposed rear-facing surface 36 (i.e., the rear-tensioner-facing surface) of the sleeve 30. The flange 46 of the rear tensioner 40 can be chamfered in any desired pattern to accommodate a wrench or other tool. In some embodiments, the through hole 45 of the boss 48 can be partially threaded (such that the threads 49 do not extend the full length of the through hole 45 as best shown in FIG. 9), creating an internal mechanical stop 47 at an internal ledge of a thread relief thereof. The rear tensioner 40 completely covers the rear end 26 (i.e., breech) of the barrel 20. In other alternative embodiments, the through hole 45 of the boss 48 may be completely threaded, allowing rear tensioner 40 to be positioned further inwardly, thus exposing the rear end 26 of the barrel. The rear tensioner 40 can have any desired length, diameter, hole size, and thread pattern. The rear tensioner 40 can be comprised of any suitable metal or metal alloy.

Figure 10:
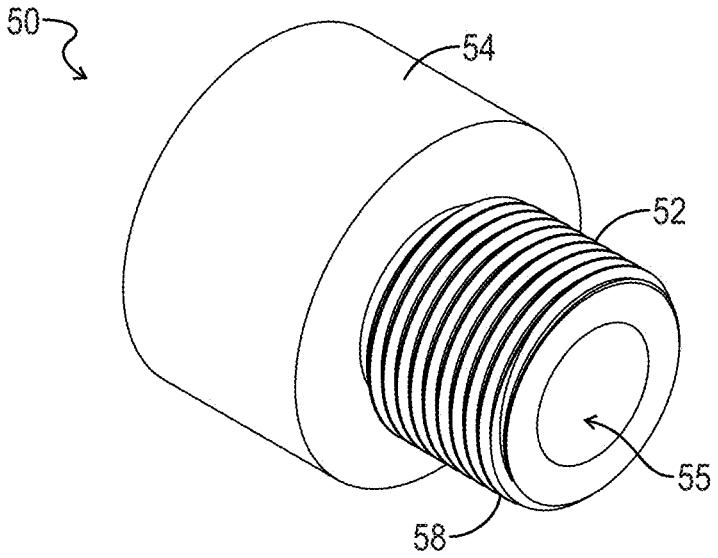
FIG. 10 is a perspective view of the front tensioner (i.e., muzzle bushing) of the barrel assembly of FIG. 4.
Figure 11:
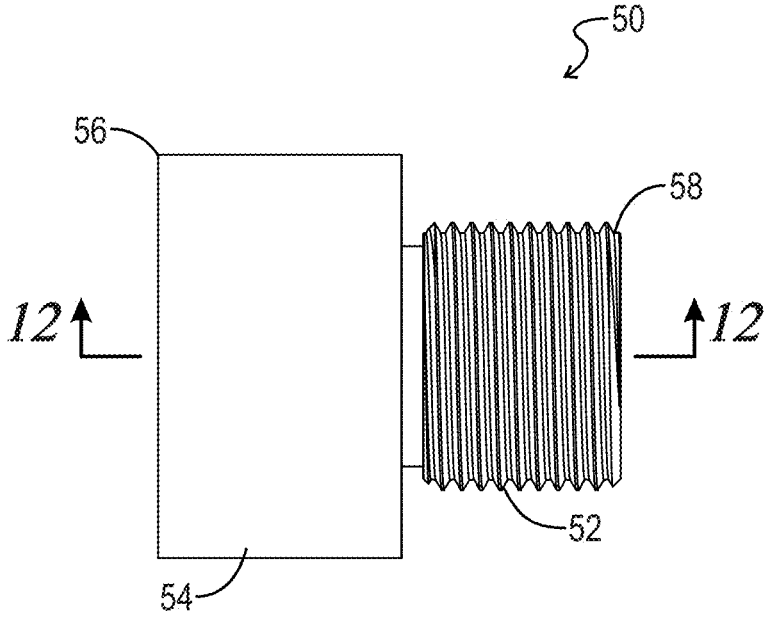
FIG. 11 is a side view of the tensioner of FIG. 10.
Figure 12:
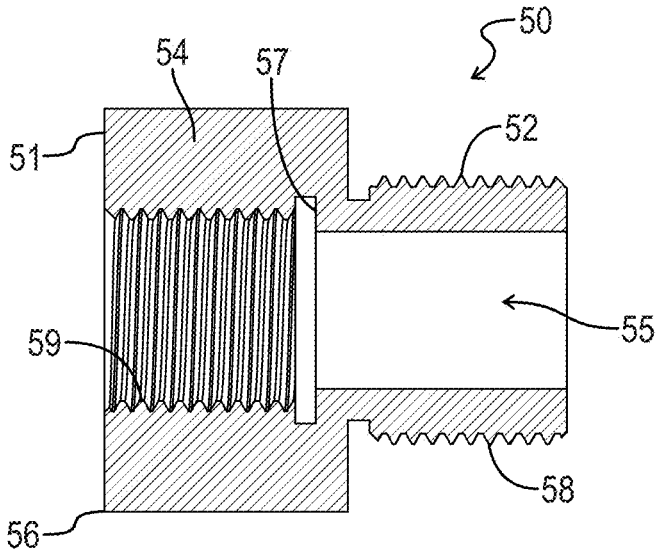
FIG. 12 a sectional view taken along line 12-12 of FIG. 11.

Referring specifically to FIGS. 10-12, in one embodiment, the front tensioner 50 can be an end bushing or jam nut that includes a head 54 with a radially protruding flange or shoulder 56 that abuts the front end 38 of the sleeve 30, a female threaded 59 through hole 55 in the head 54, and a protruding boss or stem 58 that is externally threaded with male threads 52 for correspondingly mounting the thread protector 60, a suppressor, or other muzzle device (not shown). In detail, the rear-facing surface 51 (i.e., the sleeve-facing surface) of the flange 56 of the front tensioner 50 can contact and compress the opposed front-facing surface 38 (i.e., the front-tensioner-facing surface) of the sleeve 30. The flange 56 of the front tensioner 50 may or may not be chamfered, in any desired pattern. The outer diameter of the head 54 can match the outer diameter of the sleeve 30, creating a smooth transition therebetween. The female threads 59 in the through hole 55 of the head 54 can define an internal mechanical stop 57 at an internal ledge of a thread relief thereof. The through hole 55 of the boss 58 may or may not be threaded or rifled. The boss 58 can be notched where it connects to the head 54. The front end 53 of the boss 58 can be chamfered. The front tensioner 50 can have any desired length, diameter, hole size, and thread pattern. The front tensioner 50 can be comprised of any suitable metal or metal alloy.

Figure 13:
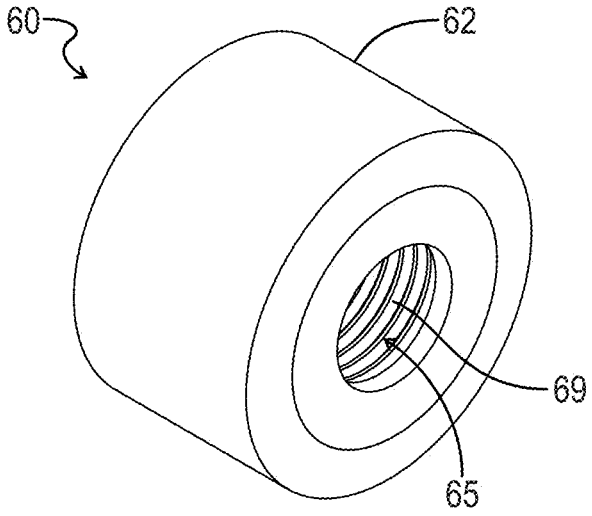
FIG. 13 is a front perspective view of the thread protector of FIG. 4.

Referring specifically to FIG. 13, in one embodiment, a thread protector 60 can be in the form of a crowned bushing 60 that includes a body 62 with a partially threaded through hole 65, which has female threads 69 that correspond to the male threads 52 of the front tensioner 50. The front of the body 62 can be crowned. The thread protector 60 is matingly engageable with the external threads 52 of the front tensioner 50 to protect the threads 52 from damage. The thread protector 60 can have any desired length, diameter, hole size, and thread pattern. The thread protector can be comprised of any suitable metal, metal alloy, or other material.

Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A barrel assembly for an airgun, comprising:

a metal barrel having a first threaded end and a second threaded end;

a composite barrel sleeve in which the barrel is received, the sleeve having a first end and a second end;

first and second tensioners threaded on the respective first and second threaded ends of the barrel against the respective first and second ends of the sleeve such that the sleeve is compressed and the barrel is tensioned by the first and second tensioners; and an adhesive rigidly securing the compressed sleeve to the tensioned barrel.

2. The barrel assembly of claim 1, wherein the sleeve has a sleeve wall thickness that is greater than a barrel wall thickness of the barrel.

3. The barrel assembly of claim 1, wherein the first and second tensioners are configured to increase a tensile strength of the barrel along an entire length of the barrel.

4. The barrel assembly of claim 1, wherein the first tensioner includes internal threads configured to threadingly engage the first threaded end of the barrel, external threads configured to threadingly engage a receiver of an airgun, and a bore through which a projectile can pass when the first tensioner is threadingly engaged with the first threaded end of the barrel and the receiver.

5. An airgun comprising the barrel assembly of claim 1.

6. A barrel assembly for an airgun, comprising:

a metal barrel having a first threaded end, a second threaded end, and a barrel length extending from the first threaded end to the second threaded end;

a composite barrel sleeve in which the barrel is received, the sleeve having a first end, a second end, and a sleeve length extending from the first end to the second end;

a first tensioner threaded on the first threaded end of the barrel and engaged with the first end of the sleeve; and a second tensioner threaded on the second threaded end of the barrel and engaged with the second end of the sleeve;

wherein the first and second tensioners are configured to compress the sleeve across the sleeve length and tension the barrel across the barrel length; and wherein the compressed sleeve is adhesively bonded to the tensioned barrel.

7. The barrel assembly of claim 6, wherein the sleeve has a sleeve wall thickness that is greater than a barrel wall thickness of the barrel.

8. The barrel assembly of claim 6, wherein the first and second tensioners are configured to increase a tensile strength of the barrel along the barrel length.

9. An airgun comprising the barrel assembly of claim 6.

10. A method of manufacturing a barrel assembly for an airgun, comprising:

coating a surface of a metal barrel with an adhesive;

assembling the adhesive-coated barrel into a composite barrel sleeve before the adhesive sets;

tightening first and second tensioners onto respective first and second threaded ends of the barrel and against respective first and second ends of the sleeve to place the barrel in tension and the sleeve in compression before the adhesive sets; and allowing the adhesive to cure while the sleeve is in compression and the barrel is in tension.

11. The method of claim 10, wherein coating a surface of a metal barrel with an adhesive includes rolling the barrel on or in an adhesive.

12. The method of claim 10, wherein assembling the adhesive-coated barrel into a composite barrel sleeve before the adhesive sets is twisting the adhesive-coated barrel into a composite barrel sleeve before the adhesive sets.

13. The method of claim 10, wherein tightening the first and second tensioners including setting a tension of the barrel before the adhesive sets.

14. The method of claim 10, wherein the adhesive is an epoxy that cures without external heat.

15. A barrel assembly for an airgun manufactured using the method of claim 10.

* * * * *